United States Patent [19]

Graham

[11] 4,385,577

[45] May 31, 1983

[54] SEWING MACHINE CONTROL MECHANISM MOUNTING PLATE

[75] Inventor: Thomas G. Graham, Emerson, N.J.

[73] Assignee: The Singer Company, Stamford, Conn.

[21] Appl. No.: 289,336

[22] Filed: Aug. 3, 1981

[51] Int. Cl.[3] ..... D05B 73/00

[52] U.S. Cl. ..... 112/258; 403/348

[58] Field of Search ..... 403/348, 353; 112/258, 112/259

[56] References Cited

U.S. PATENT DOCUMENTS

| | | | |
|---|---|---|---|
| 1,804,420 | 5/1931 | Kelley | 403/353 X |
| 3,033,138 | 5/1962 | Bono . | |
| 3,126,849 | 3/1964 | Giesselmann et al. . | |
| 3,880,546 | 4/1975 | Segal | 403/348 |
| 4,143,608 | 3/1979 | Coulombe et al. . | |

FOREIGN PATENT DOCUMENTS

| | | | |
|---|---|---|---|
| 54-6589 | 3/1979 | Japan . | |
| 54-10235 | 7/1979 | Japan . | |
| 55-15806 | 4/1980 | Japan . | |
| 55-72581 | 5/1980 | Japan . | |
| 1520891 | 8/1978 | United Kingdom | 403/353 |

*Primary Examiner*—Werner H. Schroeder
*Assistant Examiner*—Andrew M. Falik
*Attorney, Agent, or Firm*—William V. Ebs; Robert E. Smith; Edward L. Bell

[57] ABSTRACT

A control mechanism is attached to a sewing machine frame with a bayonet type connection including a slotted plate on the control mechanism and a spring biased pin which is axially movable in the frame and is extendable through an enlarged one end portion of a slot in the plate. The pin includes an enlargement which, when the plate is turned is caused to enter an opposite end portion of the slot and lock the control onto the frame.

1 Claim, 4 Drawing Figures

SEWING MACHINE CONTROL MECHANISM MOUNTING PLATE

DESCRIPTION

BACKGROUND OF THE INVENTION

This invention relates to a means for mounting a control mechanism on a sewing machine where the control mechanism is manually actuatable and therefore must be accessable from outside the sewing machine.

Such mounting means are well known in the art. See, for example, Japanese Lay-Open UM No. 54-102357, July 19, 1979, Hanyu et al, the teachings of which are incorporated herein by reference. Hanyu discloses an operator actuatable control mechanism for controlling buttonhole operations. The mechanism is back mounted by screw fasteners to a plate which is secured to the outside surface of the standard of the sewing machine. With this arrangement, the screw fasteners are visible thereby detracting from the aesthetic appearance of the machine. A further disadvantage is that when removing the control mechanism for maintenance the plate must be detached from the standard so that the control mechanism may be removed from the front of the machine. Another arrangement for mounting a buttonhole control mechanism is disclosed in U.S. Pat. No. 4,143,608, Mar. 13, 1979, Coulombe et al, the teachings of which are incorporated herein by reference. Coulombe utilizes an internal mounting arrangement wherein a mounting bracket which is integral to the structure of the control mechanism, is fastened, with screw fasteners, within the cavity of the sewing machine frame. A control knob is then assembled to a shaft projecting through a perforation in the front of the sewing machine. This arrangement has the disadvantage that it is cumbersome and awkward to assemble and disassemble for maintenance purposes or initial fabrication.

What is needed is a buttonhole control mechanism that can be easily front mounted to the sewing machine whereby screw fasteners or the like used for such mounting are not readily visible to the operator. Further, the mounting arrangement should provide for easy disassembly and reassembly for periodic maintenance purposes.

SUMMARY OF THE INVENTION

The present invention overcomes these difficulties of the prior art by providing a mounting plate for the control mechanism that engages locating devices attached to the outside of the frame of the sewing machine which are conveniently accessible and, once positioned, may be locked in place without the need for screw fasteners.

It is another object of this invention to provide a control mechanism mounting means arranged so that once the mechanism is assembled, the locating devices attached to the outside frame of the sewing machine and the locking device are completely hidden from view.

Other objects and advantages of the invention will become apparent through reference to the accompanying drawings and descriptive matter which illustrates a preferred embodiment of the invention.

According to the present invention, there is provided a sewing machine having a frame, a plurality of stitch forming instrumentalities, and a manually actuatable control mechanism for influencing the operation of one of the stitch forming instrumentalities. A mounting means is provided for removably attaching the control mechanism to the frame. The mounting means comprises a mounting plate rigidly fastened to the control mechanism, a constraining means for constraining movement of the plate to a single predefined path relative to the frame, and a locking means for restraining the plate from moving in that single predefined path.

BRIEF DESCRIPTION OF THE DRAWINGS

In order that the invention be more fully understood, it will be described by way of example with reference to the accompanying drawings in which.

DESCRIPTION OF THE PREFERRED EMBODIMENT

Figure 1:
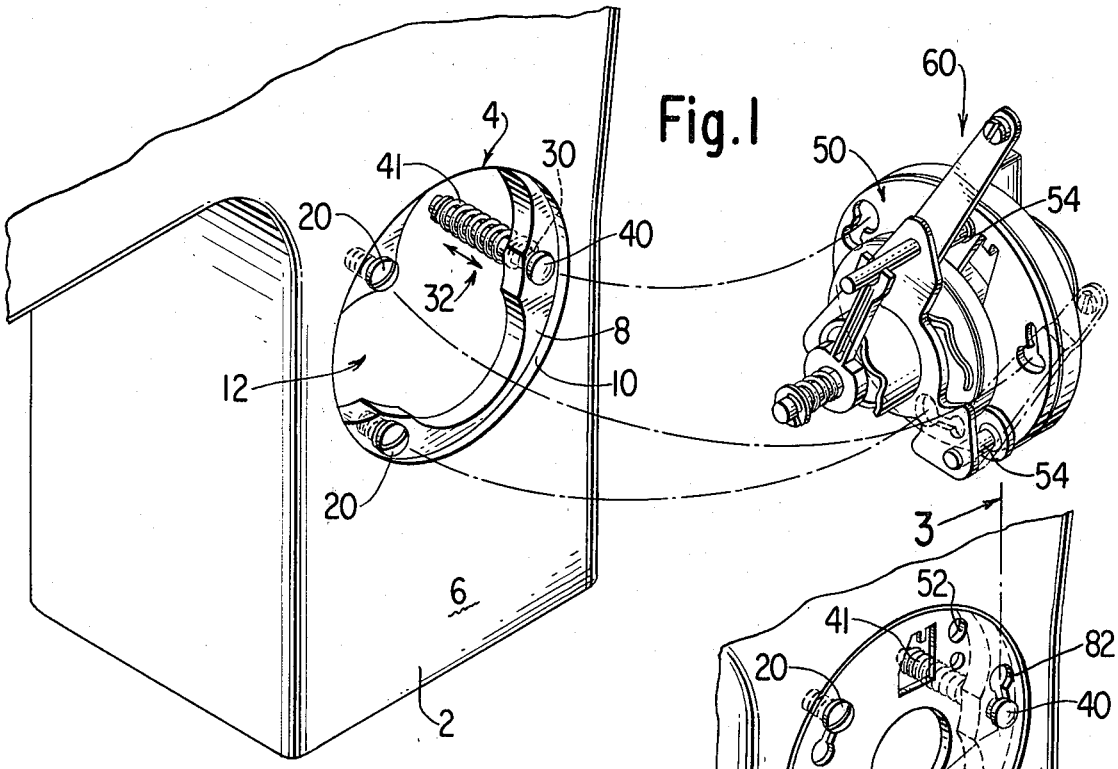
FIG. 1 is a perspective partial view of a sewing machine with the buttonhole control mechanism removed showing a preferred embodiment of the invention.
Figure 3:
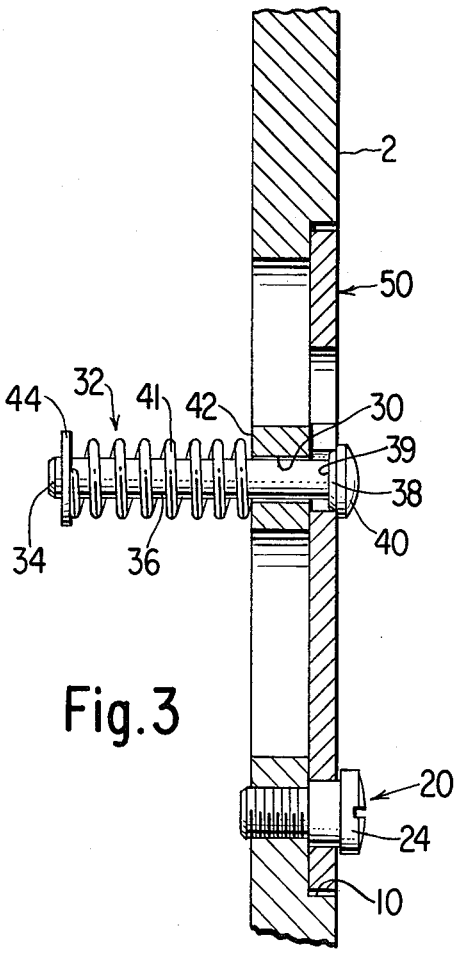
FIG. 3 is a partial section view taken along lines 3—3 of FIG. 2.

Referring to FIGS. 1 and 3, there is shown a portion of a sewing machine standard 2 having a counterbore 4 formed in its front surface 6 wherein the counterbore has a shoulder 8 and side wall 10. The shoulder 8 is perforated to permit access to sewing instrumentalities (not shown) which are contained within the interior 12 of the sewing machine. Two spaced apart shoulder screws 20 having shoulder portions 22 and heads 24 are tightly threaded into holes formed in the shoulder 8. A through hole 30 is also formed in the shoulder 8 and is substantially opposite to and on a common circle with the two shoulder screws 20. A locking pin assembly 32 is provided and includes a pin 34 having a shank 36 which slidingly engages the through hole 30. The extremity of the pin 34 projecting outwardly terminates in an enlarged diameter 38 and a round head 40 which is larger in diameter than the diameter 38. Additionally, the locking pin assembly 32 includes a helical compression spring 41 which surrounds the shank 36 and abuts, on the one end, the interior wall 42 of the standard 2 and abuts, on the other end, a snap ring 44 inset into a groove formed in the shank 36. The spring 41 is arranged to bias the pin 34 in a direction toward the interior of the standard 2 so that the edge 39 of the enlarged diameter 38 abuts the shoulder 8. The spring 41 may be compressed by pressing the shank end of the pin 34 with the finger thereby causing the shank 36 to slide within the through hole 30 so that the head 40 moves outwardly and away from the shoulder 8.

Figure 2:
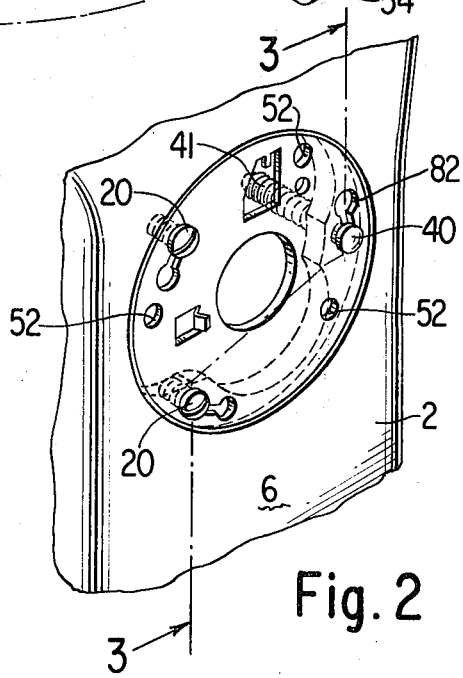
FIG. 2 is a perspective partial view of a sewing machine similar to that of FIG. 1, but with the mounting plate installed in place.
Figure 4:
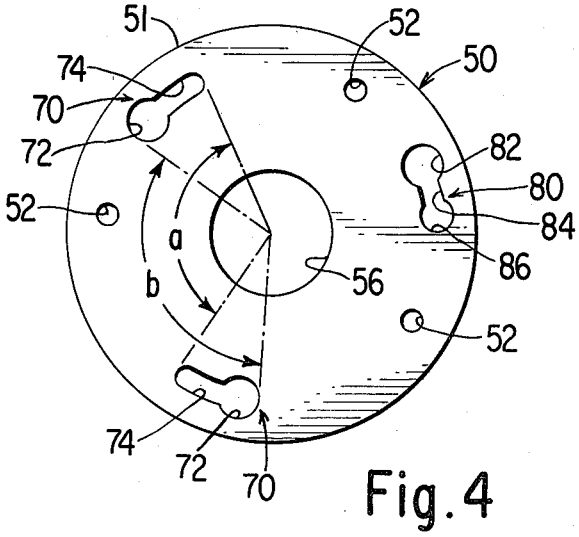
FIG. 4 is a plan view of the mounting plate shown in FIG. 2.

Referring to FIGS. 2 and 4, there is shown a mounting plate 50 having an outer diameter 51 slightly smaller than that of the counterbore 4. Three spaced apart mounting holes 52 having stand-off studs 54 attached thereto shown in FIG. 1, are provided for securing the mounting plate 50 to the buttonhole control mechanism generally shown at 60 in FIG. 1. A central perforation 56 is formed in the plate 50 to accommodate the control mechanism 60. There are two keyhole shaped holes 70 formed in the plate 50, each having an enlarged circular end 72 and a relatively narrow slot portion 74 arcuately formed in a clockwise direction from the end 72. A third hole 80, also formed in the plate 50 has an enlarged circular end 82, a relatively narrow slot portion 84 arcuately formed in a clockwise direction and terminating in enlarged end 86 that is somewhat larger than the width of the slot portion but smaller than the enlarged end 82. The three arcuate slots 74, 74 and 84 are on a common circle which is concentric to the central perforation 56 and equal in diameter to the common circle containing the two shoulder screws 20 and the through hole 30. Additionally, the enlarged circular ends 72, 72 and 82 are spaced in registry with the shoulder screws 20, 20 and the through hole 30, respectively.

The two keyhole shaped holes 70 are proportioned so that the enlarged circular ends 72 are large enough for the heads 24 of the shoulder screws 20 to pass unobstructed therethrough and the slot portions 74 will slidingly accommodate the shoulder portions 22. The third hole 80 is proportioned so that the enlarged circular end 82 is large enough for the head 40 of the pin 34 to pass unobstructed therethrough, the slot portion 84 will slidingly accommodate the shank 36, and the enlarged end 86 is sufficiently large for the enlarged diameter 38 of the pin 34 to pass therethrough but will not allow the head 40 to pass therethrough.

In operation, the control mechanism 60, with the mounting plate 50 attached thereto, is inserted into the counterbore 4 so that the control mechanism operationally engages the sewing instrumentalities (not shown) which are contained within the interior 12 of the sewing machine. The mounting plate 50 is positioned so that the heads 24, 24 of the shoulder screws 20, 20 and the head 40 of the pin 34 are in alignment with the enlarged circular ends 72, 72 and 82, respectively. The control mechanism 60 is then urged inwardly until the plate 50 seats against the shoulder 8 of the counterbore 4 whereby the heads 24, 24 have completely passed through the circular ends 72, 72. The pin 34 is then urged by an operator's finger in an outwardly direction against the biasing force of the spring 41 until the enlarged diameter 38 has completely passed through the enlarged circular end 82. While the pin 34 is maintained in this position, the plate 50 is urged to rotate counterclockwise, as viewed in FIG. 2, causing the arcuately formed slot portions 74, 74 and 84 to slidingly engage the shoulder portions 22, 22 of the shoulder screws and the shank 36 of the pin respectively. Rotation of the plate 50 continues until the enlarged end 86 is in alignment with the enlarged diameter 38 of the pin 34. The pin 34 is then permitted to move inwardly, under the biasing force of the spring 41 until the enlarged diameter 38 lockingly engages the enlarged end 86 of the third hole 80. The control mechanism 60 is now locked in operating position. It may be removed by urging the pin 34 in an outwardly direction, as before, and simply reversing the above described procedure.

There are many advantages associated with this construction. Most importantly the control mechanism is assembled or disassembled without the need of screw fasteners which can be cumbersome and inconvenient to use. Once assembled, the shoulder screws and spring biased locking pin are completely hidden from view thereby providing a more pleasing aesthetic appearance.

Upon reviewing the disclosure, a number of alternative constructions will occur to one skilled in the art. Such constructions may utilize fixed projections formed in the frame of the sewing machine in place of the shoulder screws and the mounting plate may undergo a linear motion instead of a rotary motion to effect locking. Further, the actual shape of the holes formed in the mounting plate for engagement with the shoulder screws and the locking pin may vary to accommodate a variety of different such shoulder screws or projections and locking pins. Such alternative constructions are considered to be within the spirit and scope of this disclosure.

I claim:

1. A sewing machine having a frame, a plurality of stitch forming instrumentalities, a manually actuatable control mechanism for influencing the operation of one of said plurality of stitch forming instrumentalities, and mounting means for removably attaching said control mechanism to said frame, wherein said mounting means comprises:

a. a mounting plate rigidly fastened to said control mechanism;

b. a constraining means for constraining movement of said plate to substantially a single predefined path relative to said frame including a slot in said plate and a pin in the frame for sliding engagement along the slot, the pin including a head with a diameter which is larger than the width of the slot except for an enlarged one end which is sufficiently large to allow the head to pass therethrough, and c. a locking means for affixing the plate to said frame including an enlarged diameter on the pin under the head and an end portion of said slot adapted to receive the enlarged diameter of the pin while excluding the head, and a spring about the pin for biasing the enlarged diameter into said adapted end portion of the slot and the head of the pin against the plate, the pin having a finger engageable end which is at the opposite end of the pin from the head and to which manual pressure can be applied to enable the plate to be connected to and disconnected from the frame.

* * * * *